US006509295B1

(12) United States Patent
Cooper et al.

(10) Patent No.: US 6,509,295 B1
(45) Date of Patent: Jan. 21, 2003

(54) RECORD MATERIAL FOR PRESSURE-SENSITIVE COPYING SYSTEMS

(75) Inventors: John Brian Cooper, Hampshire (GB); Christian Dumoulin, Nivelles (BE); Ivan Sheiham, Buckinghamshire (GB); Margaret Patricia Templey, Oxfordshire (GB)

(73) Assignee: Arjo Wiggins Limited (GB)

( * ) Notice: Subject to any disclaimer, the term of this patent is extended or adjusted under 35 U.S.C. 154(b) by 0 days.

(21) Appl. No.: 09/403,983

(22) PCT Filed: Apr. 24, 1998

(86) PCT No.: PCT/GB98/01216

§ 371 (c)(1),
(2), (4) Date: Feb. 4, 2000

(87) PCT Pub. No.: WO98/49014

PCT Pub. Date: Nov. 5, 1998

(30) Foreign Application Priority Data

Apr. 29, 1997 (GB) ..... 9708582

(51) Int. Cl.[7] ..... B41M 5/136
(52) U.S. Cl. ..... 503/206; 503/200; 503/215
(58) Field of Search ..... 503/200, 206, 503/226

(56) References Cited

U.S. PATENT DOCUMENTS 5,137,797 A * 8/1992 Nakamura ..... 430/211

FOREIGN PATENT DOCUMENTS

| | | |
|---|---|---|
| DE | 2233681 | 1/1974 |
| EP | 407245 | 1/1991 |
| GB | 967390 | 8/1964 |

* cited by examiner

*Primary Examiner*—Bruce H. Hess
(74) *Attorney, Agent, or Firm*—Burns, Doane, Swecker & Mathis, L.L.P.

(57) ABSTRACT

A security feature is imparted to record material for use in pressure-sensitive copying paper systems by dyeing the surface sizing composition and/or other coatings present in the paper and then applying the dyed composition or coating in a manner such as to produce an uneven coating pattern, for example a film-split pattern. The dye accentuates the coating pattern and produces a visual effect which is difficult to replicate without access to a papermaking or paper coating machine, and which has a distinguishably different appearance from that of the opposite surface of the reccord material. The invention is particularly suited for use with a Billblade coater which applies a dyed surface sizing composition to one surface of the paper and a pigment coating to the other surface or with a metered size press coater.

7 Claims, 1 Drawing Sheet

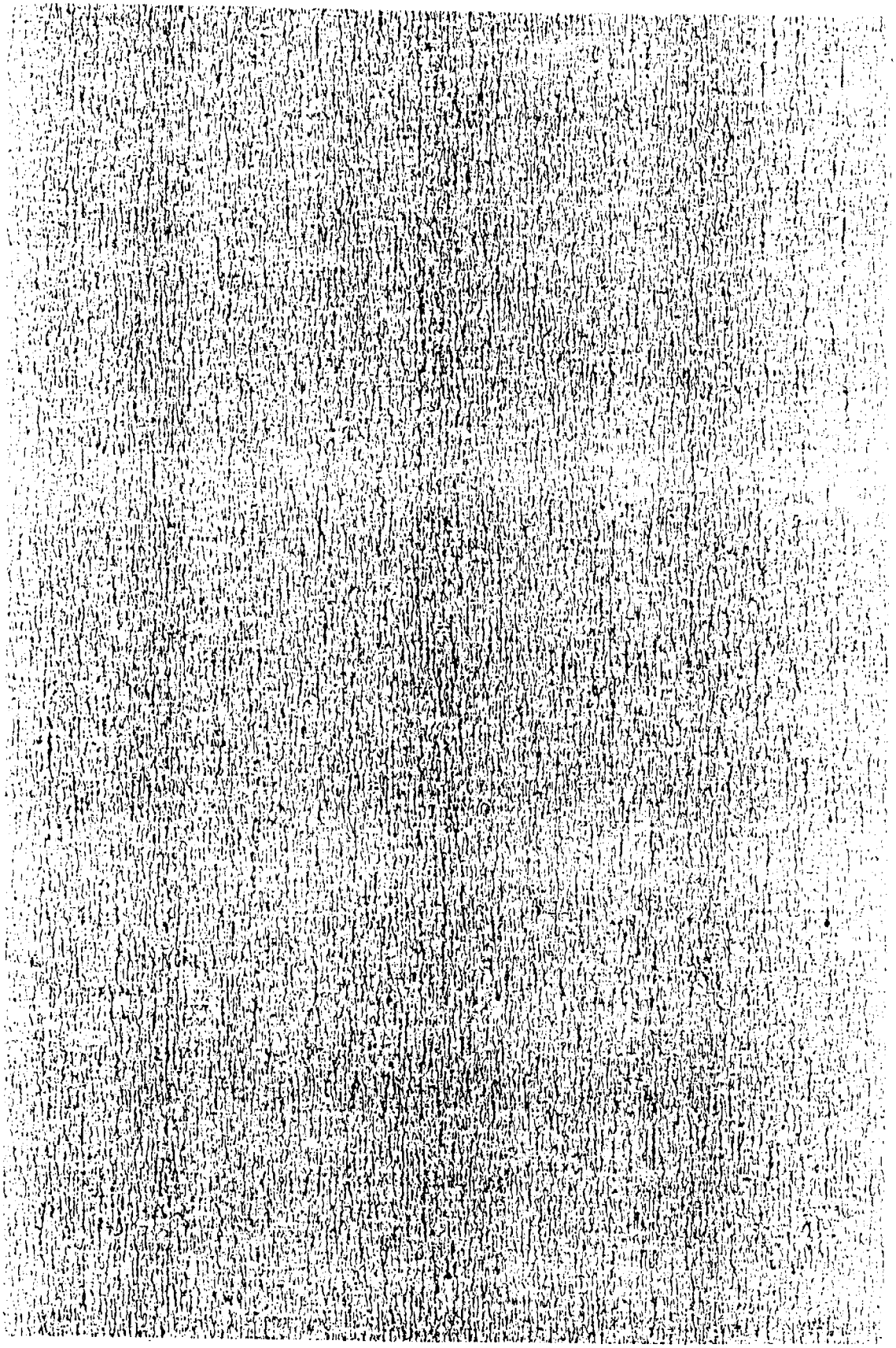

RECORD MATERIAL FOR PRESSURE-SENSITIVE COPYING SYSTEMS

This invention relates to record material for use in pressure-sensitive copying systems. Such record material is also known as carbonless copying paper.

Pressure-sensitive copying systems are well-known and are widely used in the production of business forms sets. Various types of pressure-sensitive copying system are known, of which the most widely used is the transfer type. A business forms set using the transfer type of pressure-sensitive copying material comprises an upper sheet usually known as a "CB" sheet) coated on its lower surface with microcapsules containing a solution in an oil solvent or solvent composition of at least one chromogenic material (alternatively termed a colour former) and a lower sheet usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot-matrix or daisy-wheel printing) ruptures the microcapsules, thereby releasing or transferring chromogenic material solution on to the colour developer composition and giving rise to a chemical reaction which develops the colour of the chromogenic material and so produces a copy image.

In a variant of the above-described arrangement, the solution of chromogenic material may be present as isolated droplets in a continuous pressure-rupturable matrix instead of being contained within discrete pressure-rupturable microcapsules.

In another type of pressure-sensitive copying system, usually known as a self-contained or autogenous system, microcapsules and colour developing co-reactant material are coated onto the same surface of a sheet, and writing or typing on a sheet placed above the thus-coated sheet causes the microcapsules to rupture and release the solution of chromogenic material, which then reacts with the colour developing material on the sheet to produce a coloured image.

Business forms sets utilising pressure-sensitive copying materials can be put to a wide variety of uses in, for example, business, commerce, and national and local government administration. For some of the many actual or potential uses of these products, it is desirable that at least one of the sheets making up the set should incorporate a security feature of some kind, in order that its authenticity can be verified. This is the case, for example, if one of the sheets of the set is to be used as proof of entitlement to a payment, or example an unemployment, sickness or pension benefit or a refund of tax or customs duty. Such payments are often made on presentation of appropriate documentation to a cashier. It is desirable that the cashier should be able to verify the authenticity of the documentation presented before payment is made. There is therefore a need for pressure-sensitive copying material incorporating a security feature by means of which its authenticity can be verified.

In principle, a security feature could be provided in a business forms set by the use of a conventional security paper as the base paper for subsequent coating with microcapsules and colour developer composition. Such security paper, an example of which is disclosed in our European Patent Application No. 391542A, can be authenticated by the use of an authenticating reagent which produces a colour change on application to the genuine security paper. In practice however, such security papers are normally too expensive for use in business forms sets, except for specialities such as cheques.

Our European Patent Application No. 0771669A relates to the use of fluorescent chromogenic material(s) to provide a security feature in pressure-sensitive copying material. This represents a significant advance in the art, but there is a market requirement for pressure-sensitive copying systems offering alternative or additional security features. It is therefore an object of the present invention to provide pressure-sensitive copying material incorporating a cost-effective and readily-verifiable security feature.

We have now discovered that a useful and readily verifiable security feature can be obtained if one or more of the coatings used in the production of record material for use in pressure-sensitive copying systems (including surface sizing coatings) is coloured by the addition of a dye or other colouring agent and then applied to the base paper substrate by a method which results in a film-split or other uneven coating pattern, i.e. an uneven distribution of the coating over the base paper surface. This is because the colouring agent has the effect of accentuating the coating pattern. Such coating patterns are difficult to replicate without access to large and expensive paper making and/or coating equipment. Whereas paper coating technologists normally seek to eliminate or minimise coating patterns, the present invention turns what is normally a drawback into a benefit.

According to a first aspect of the invention, there is provided record material for use in pressure-sensitive copying systems, said record material comprising a paper substrate optionally surfaced-sized with a surface sizing composition and carrying:

(a) a coating of isolated droplets of an oil solution of chromogenic material, said droplets being confined within respective pressure-rupturable barriers; and/or (b) a coating of a colour developer material effective to develop the colour of an oil solution of chromogenic material on contact therewith;

said coatings, when both present, being on opposite surfaces of the substrate or on the same surface thereof, and when present on the same surface being either in separate layers or mixed in a single layer, characterised in that:

(c) at least one of the surface sizing composition, said coatings, or a further coating carried by the substrate is coloured by the presence of a dye or other colouring agent and has an uneven coloured coating pattern, which is accentuated by the colouring agent, the surface of the record material carrying the coloured coating pattern thus being of a distinguishably different appearance from that of the opposite surface of the record material.

In a second aspect, the present invention provides a method of producing record material for use in pressure-sensitive copying systems, said record material comprising a paper substrate optionally surface-sized with a surface sizing composition and carrying:

(a) a coating of isolated droplets of an oil solution of chromogenic material, said droplets being confined within respective pressure-rupturable barriers; and/or (b) a coating of a colour developer material effective to develop the colour of an oil solution of chromogenic material on contact therewith;

said coatings, when both present, being on opposite surfaces of the substrate or on the same surface thereof, and when present on the same surface being either in separate layers or mixed in a single layer, characterised by the steps of:

(c) adding a dye or other colouring agent to at least one of the surface sizing composition, said coatings, or a further coating carried by the substrate; and (d) applying and/or smoothing the coloured composition or coating by a method which results in an uneven coloured coating pattern;

whereby the coating pattern is accentuated by the presence of the colouring agent and is of a distinguishably different appearance from that of the opposite surface of said record material.

In a third aspect, the present invention provides a business forms set comprising pressure-sensitive copying material as just defined.

The further coating referred to above can be a coating present solely for colouration purposes or a coating having an additional technical function, for example, a precoat beneath the coating of isolated droplets of oil solution.

The surface size, when present, can be conventional in nature, for example it may be a starch or polyvinyl alcohol surface size.

The pressure-rupturable barrier within which each droplet of chromogenic material solution is confined is typically the wall of a microcapsule. Alternatively, the pressure-rupturable barrier can be part of a continuous pressure-rupturable matrix as referred to earlier.

The paper substrate may be white or coloured. The hue of the dye or other colouring agent used should differ from the hue of the base paper, and should be such as to be readily noticeable to the human eye. Although it is generally easiest to use a dye as the colouring agent in the present invention, in principle the colouring agent could take another form, for example it could be a particulate coloured pigment ("coloured" in this context includes white) Preferably, the colouring agent is a dye of a type having a strong affinity for cellulosic fibres as used in paper making, so that it will fix to the fibres and not be displaced by any subsequent processing.

The colouring agent can be added to a surface sizing formulation, a microcapsule composition or a colour developer formulation. The concentration of colouring agent used can be determined in accordance with the intensity of pattern desired. Adjustment of colouring agent concentration to vary the intensity or She pattern obtained can itself provide a supplementary security feature. Where the base paper has sizing composition and/or coatings applied to both of its surfaces, the composition(s) or coating(s) can both be coloured if desired, provided the resulting coloured coating patterns are distinguishably different. This will be the case if colouring agents of different hues are used, but the same colouring agent can be used for both surfaces, provided the intensity of colouration and/or the type of coating pattern on the two surfaces are distinguishably different.

Where the colouring agent is a dye, its degree of affinity for cellulosic paper making fibres is less significant when it is to be used in the microcapsule coating than when used in a starch surface sizing formulation, since there is less direct contact with the paper substrate. However, the use of fibre-fixing dyes can still be beneficial, even in a microcapsule coating.

In one particularly preferred embodiment of the invention, the surface sizing composition comprising the colouring agent is applied to the substrate by means of the roll element of a Billblade coater at the same time as a colour developer coating is applied to the opposite surface of the substrate by means of the blade element of the Billblade coater. The result is a CF paper having a distinctive film-split pattern in the surface size coating which pattern is highlighted and made more noticeable by the presence of the colouring agent. The distinctiveness of the resulting pattern enhances its value as a security feature. Since the result is achieved simply by addition of colouring agent to an otherwise conventional surface sizing composition, achievement of a security feature in this way is very cost-effective.

A metered size press coater may be used instead of a Billblade coater for applying surface size to one surface of the substrate and a colour developer coating to the opposite surface to produce CF paper. A metered size press coater can also be used to produce CB paper if a microcapsule coating composition is applied to the opposite surface of the substrate, instead of a colour developer coating. Other possibilities offered by a metered size press coater include the application of a precoat as referred to above to one surface of the substrate and a surface sizing composition or colour developer composition to the other surface. In each case, the size composition can be coloured, with the CF, CB or precoat coating uncoloured, or vice versa. Alternatively the surface size composition and the CF, CB or precoat coating can both be coloured, provided the colours are different or of distinguishably different intensities. A metered size press coater can of course also be used just for surface sizing, i.e. applying the same or different surface sizing compositions to the opposite surfaces of the base paper substrate, with one or both compositions being coloured (in the latter case, the colours must we different or of noticeably different Intensities unless the coater can be operated to give distinguishably different types of coating pattern on the two surfaces). Metered size press coaters are commercially available from Voith under the name "Speed-sizer"; from Valmet under the name "Sym-sizer"; from Jagenberg under the name "Filmpress"; and from BTG under the name "Twin HSM". Whilst they have been designed with a view to eliminating or minimising the occurrence of film-split or other coating patterns, they can be operated in such way as to produce a coating pattern sufficient for the purposes of the present invention.

A CF product made as described above can readily be made into a CFB product by the subsequent application of a suitable microcapsule coating over the coloured surface size. Since microcapsule coatings are normally transparent or translucent, the coloured surface size will still be visible and effective as a security feature.

In another preferred embodiment of the invention, a colouring agent of different hue to that of the base paper is added to a microcapsule coating composition prior to its application to the base paper by a roll-coating or other method which produces an uneven coating pattern. As already described in general terms, the effect of the colouring agent is to accentuate irregularities in the evenness with which the coating is distributed over the surface of the base paper and thus to produce a distinctive coloured pattern.

If desired, the mode of operation of the coating equipment, for example coating or smoothing roll speeds, can be modified so as deliberately to obtain a more uneven coating distribution than normal and thereby a more distinctive coloured pattern. However, our experience is that this is not normally necessary, as the roll-coating and/or roll-smoothing processes conventionally used or coating microcapsules inevitably result in a "film-split pattern" which is sufficiently distinctive without further modification.

The present pressure-sensitive copying material may be used not only for applications in which the material provides proof of entitlement to a payment as described earlier but also for other applications where security is important. One such application is tickets for sporting or theatre events or the like or for travel. Another such application is documents providing evidence of a right to enter a restricted area or territory, where entry is granted on presentation of documentary authority, for example to a gatekeeper or receptionist or to a border or immigration official.

When the present record material comprises an oil droplet coating, whether coloured or uncoloured, the chromogenic material present may include a fluorescent component as an additional security feature, as disclosed in our above-mentioned European Patent Application No. 0771669 A.

In other respects, the pressure-sensitive copying material can be conventional. Thus the microcapsules may be produced by coacervation of gelatin and one or more other polymers, e.g. as described in U.S. Pat. Nos. 2,800,457; 2,800,458, or 3,041,289; or by in situ polymerisation of polymer precursor material, e.g. as described in U.S. Pat. Nos. 4,001,140; 4,100,103; 4,105,823 and 4,396,670, or by interfacial techniques such as disclosed in U.S. Pat. Nos. 4,379,071; 4,428,983; 4,412,959; 4,253,682; or 4,181,639.

The chromogen-containing microcapsules, once produced, are formulated into a coating composition with a suitable binder, for example starch or a starch/carboxymethylcellulose mixture, and a particulate agent (or "stilt material") for protecting the microcapsules against premature microcapsule rupture. The stilt material may be, for example, wheatstarch particles or ground cellulose fibre floc or a mixture of these. The resulting coating composition is then applied by conventional coating techniques, for example metering roll coating or air knife coating.

The thickness and grammage of the base paper used in the present record material can be as conventional for this type of product, for example the thickness may be about 60 to 90 microns and the grammage about 35 to 50 g $m^{-2}$, or higher, say up to about 100 g $m^{-2}$, or even more. This grammage depends to some extent on whether the final paper is for CB, CF, CFB or self-contained use. The higher grammages just quoted are normally applicable only to speciality CB papers. The base paper may be acid-sized (typically rosin-alum sized) or neutral- or alkaline sized, for example with alkyl ketene dimer or succinic anhydride sizes. If neutral- or alkaline-sizing is used, the paper is preferably treated with an agent for counteracting discolouration, as disclosed more fully in our European Patent Application No. 576176A or No. 491487A.

The solvent used to dissolve the chromogenic materials can be chosen, for example, from partially hydrogenated terphenyls, alkyl naphthalenes, diarylmethane derivatives, dibenzyl benzene derivatives, alkyl benzenes and biphenyl derivatives, optionally mixed with diluents or extenders such as kerosene, or from vegetable oils, optionally mixed with esters. Such vegetable oil-based systems are disclosed in our European Patent Applications Nos. 520639A, 573210A and 593192A.

The colour developer material used may be an acid clay, e.g. as described in U.S. Pat. No. 3,753,761; a phenolic resin, e.g. as described in U.S. Pat. No. 3,672,935 or U.S. Pat. No. 4,612,254; or an organic acid or metal salt thereof, e.g. as described in U.S. Pat. No. 3,024,927, European Patent Application Nos. 275107A, 503443A or 521474A, or German Offenlegungsschrift No. 4110354A. The colour developer material is formulated into a coating composition with a suitable binder, for example a styrene-butadiene or other latex. The composition may of course be coloured to provide the security feature of the invention.

Additional security features can be incorporated in the present record material if desired, for example by dyeing the stilt material prior to use or by the inclusion of microcapsules containing coloured dyes. Both of these expedients produce a coating containing coloured specks visible with a hand lens. A further possibility is the inclusion of fluorescent pigment granulates as disclosed in European Patent No. 226367B.

The invention will now be illustrated by the following Examples, in which all parts and percentages are by weight unless otherwise stated:

EXAMPLE 1

A fibre-fixing disazo red dye ("Pergasol* Red 2B liquid" supplied by Ciba Speciality Chemicals as a wet dye concentrate) was added to two conventional aqueous starch surface sizing compositions each containing 3% by weight of acetylated corn starch ("Collofilm* 124" supplied by Amylum). The concentration of red dye was 0.7% by weight in one batch and 1.4% by weight in the other calculated in both cases as weight of wet dye concentrate as supplied to total wet weight of surface sizing composition.

The resulting dyed solutions were applied separately to one surface of a conventional yellow carbonless base paper by means of the roll element of a Billblade coater, the blade element of which simultaneously applied a yellow-hue conventional clay-based colour developer composition to the other surface of the paper. In both cases a distinctive and clearly discernable red pattern was obtained, with the yellow base paper showing through. The higher dye concentration composition gave a much more intense pattern, and it is probable that with this particular dye, 0.7% is close to the minimum effective dye concentration which could be used. The type of pattern obtained is shown in the accompanying Figure, which is a photocopy of the coloured pattern obtained, the darker areas representing red and the lighter areas yellow.

Sheets of the resulting papers and of a yellow control CF paper for which the surface size had not been dyed red were then laboratory-coated on their starch-sized surface with a microcapsule composition as conventionally used in carbonless copying paper at a dry coatweight of ca. 5–5.5 g $m^{-2}$. This composition contained, on a dry basis, 66% of microcapsules, 24.3% of particulate wheatstarch stilt material and 9.7% of a cooked starch binder. The microcapsules contained a red-developing chromogenic material ("Pergascript* Red I-6B" supplied by Ciba-Geigy) and a fluorescent yellow-developing chromogenic material ("Pergascript* Yellow I-3R") in 4:1 weight ratio in a 2:1 weight ratio mixture of a di-isopropylnaphthalene blend and kerosene. The microcapsules had been produced by a conventional gelatin coacervation microencapsulation process as generally described in British Patent No. 870476, using carboxymethyl cellulose and vinyl methyl ether/maleic anhydride copolymer as anionic colloids.

It was observed that the microcapsule coating did not obscure or change the appearance of the underlying coloured pattern. When the microcapsule coated surface was illuminated with UV light from a hand-held UV lamp, it was observed that the presence of the underlying coloured pattern did not interfere with the fluorescence produced by the fluorescent chromogenic material, i.e. it was the same as that obtained with the control paper.

The use of the symbol * in this and subsequent Examples denotes a trade mark.

EXAMPLE 2

This illustrates the use of dyed but otherwise conventional microcapsule compositions to produce patterned CB and CFB products. The dye used was as in Example 1, and was present in the microcapsule compositions at a level of 0.3% based on wet dye concentrate as supplied to total dry weight of coating composition. The dyed compositions were applied to white base paper and to the uncoated surface of yellow CF paper by means of an intermediate-scale pilot roll coater equipped with aftersmoothing rolls. The web speed of the paper during microcapsule coating was either 400 m $min^{-1}$ or 700 m $min^{-1}$, and the smoothing rolls were run a various different speeds so as to achieve a range of coating patterns.

It was found in every case that a distinctive coloured coating pattern was obtained and that the microcapsule-coated surface of the web was of a distinctively different hue from that of the surface of the web which was not microcapsule-coated.

EXAMPLE 3

This illustrates the use of variety of different dyes for colouring the microcapsule composition. These were all supplied as wet concentrates and were as follows:

A. "Astrazon* Blue FBL" (an azacyanine liquid dyestuff preparation supplied by Bayer and containing 30–40% C.I. Basic Blue 159) used at addition levels of 0.25%, 0.5% and 1.0%.

B. "Levacell* FT Blue 4G-N (an azo copper complex dyestuff preparation based on bis-diazotised 3,3'-methoxybenzidene, supplied by Bayer and containing 20% C.I. Direct Blue 218), used at addition levels of 0.5% and 1.0%.

C. Mixture of "Pergasol* Turquoise F-2G" (a phthalocyanine liquid dyestuff preparation supplied by Ciba Speciality Chemicals and containing C.I. Basic Blue 100) and "Levacell* Fast Yellow GF-N" (an azo liquid dyestuff preparation supplied by Bayer and containing C.I. Direct Yellow 147) in approximately 1:1 proportion.

D. Mixture of "Levacell* Fas yellow GF-N" and "Pergasol* Turquoise F-2G" in approximately 1:2 proportion.

E. "Pergasol* Red 2B" used at addition levels of 0.5%, 1.0% and 2.7%.

The various dyed microcapsule compositions were applied to he uncoated surface of yellow 57 g $m^{-2}$ CF paper by means of a small scale pilot roll coater. In all cases, distinctive coating patterns were obtained, although those obtained with "Astrazon Blue FBL" were less distinctive than the others.

EXAMPLE 4

An aqueous coating composition for use as a precoat beneath a microcapsule coating in pressure-sensitive record material was made up at 46.2% solids content from the following:

| | |
|---|---|
| Kaolin ("SPS"* supplied by English China Clays, United Kingdom) | 100 parts (dry) |
| Oxidised potato starch binder ("Perfectamyl* P255 SH supplied by Amylum N.V., Belgium) | 20 parts (dry) |

-continued

| | |
|---|---|
| Cyclic amide-aldehyde condensate cross-linking agent ("Sunrez 700M*, product of Sequa Chemicals Inc. USA) | 1 part (dry) |

50 ml of red dye concentrate ("Pergasol* Red 2B") was added to 70 Kg of aqueous coating composition prepared as just described (this represents ca. 155 g of dye concentrate per 100 Kg dry coating composition).

The resulting dyed composition was then applied to one surface of a conventional white base paper at a dry coat-weight of ca. 4.7 g $m^{-2}$ by means of a pilot scale blade coater. The coater was operated in a manner such as not to avoid the occurrence of a coating pattern. The resulting paper had a pinkish appearance on the coated surface, but was white on the reverse. On examination of the pink surface with the naked eye, it was found to comprise a subtle but clearly discernible red-on-white mottle pattern in which the dye accentuated the coating pattern. The coating pattern was not readily discernable on a control paper coated in the same way with an undyed coating composition which was otherwise identical to that described above. When a microcapsule composition is applies over the red-on-white mottle pattern and dried, the pattern is still visible through the microcapsule coating.

EXAMPLE 5

This illustrates the use of a metered size press coater (pilot-scale) for applying a conventional clay-based colour developer composition to one surface of a white base paper and an inert kaolin pigment precoat composition to the other surface (the precoated surface was intended subsequently to be coated with a microcapsule composition). The precoat was coloured blue by the addition of blue dye at a level of ca. 0.125 Kg dye per 100 Kg coating composition on a dry basis. The resulting coated paper was white on one surface (the CF surface) and generally blue on the other surface, the blue surface having a noticeable mottled coating pattern with the white base paper showing through.

EXAMPLE 6

This also illustrates the use of a pilot-scale metered size press coater for applying a conventional clay-based colour developer composition to one surface of a white base paper and an inert kaolin pigment precoat composition to the other surface. However, in contrast to Example 5, both compositions were coloured blue by the addition of blue dye (addition level 0.5 Kg of dye per 100 Kg coating composition on a dry basis in each case). The resulting coated paper was blue on both surfaces but the coating patterns on the surfaces were noticeably different (the coating pattern on the colour developer surface was more pronounced than on the precoat surface). In each case the white base paper showed through on close examination.

What is claimed is:

1. Record material for use in pressure-sensitive copying systems, said record material comprising a paper substrate optionally surfaced-sized with a surface sizing composition and carrying:

(a) a coating of isolated droplets of an oil solution of chromogenic material, said droplets being confined within respective pressure-rupturable barriers; and/or (b) a coating of a colour developer material effective to develop the colour of an oil solution of chromogenic material on contact therewith;

said coatings, when both present, being on opposite surfaces of the substrate or on the same surface thereof, and when present on the same surface being either in separate layers or mixed in a single layer, characterised in that:

(c) at least one of the surface sizing composition, or said coatings is coloured by the presence of a dye or other colouring agent and is applied and/or smoothed by a method which results in an uneven coloured coating pattern, whereby the coating pattern is accentuated and the surface of the record material carrying the coloured coating pattern is of a distinguishably different appearance from that of the opposite surface of the record material.

2. Record material as claimed in claim 1, wherein the coating having the uneven coloured coating pattern is of a surface sizing composition containing a colouring agent.

3. Record material as claimed in claim 1, wherein the coating having the uneven coloured coating pattern is of a microcapsule coating composition containing a colouring agent.

4. Record material as claimed in claim 1 wherein the coating having the uneven coloured coating pattern is of a colour developer composition containing a colouring agent.

5. Record material as claimed in claim 1 wherein the colouring agent is a dye of a type having a strong affinity for cellulosic fibres, so that it fixes to the fibres of the paper substrate.

6. Record material as claimed in claim 1 wherein the chromogenic material includes a fluorescent component.

7. A business forms set comprising pressure-sensitive copying material as claimed in claim 1.

* * * * *